US006033551A

United States Patent [19]

Kovsman et al.

[11] Patent Number: 6,033,551

[45] Date of Patent: Mar. 7, 2000

[54] SYNTHESIS OF METAL 2-ETHYLHEXANOATES

[76] Inventors: E. P. Kovsman, Lenina prosp., 137, #4, 300026, Tula; M. I. Yanovskaya, B. Pereyaslavskaya, 17, #6, 129041, Moscow; B. G. Soldatov, Lenina prosp., 133-b, #11, 300026, Tula; G. V. Mozak, Khvorostuhina, 7, #15, 300010, Tula, all of Russian Federation

[21] Appl. No.: 08/974,666

[22] Filed: Nov. 19, 1997

[51] Int. Cl.[7] ..... C25B 3/00; C25B 3/12

[52] U.S. Cl. ..... 205/440; 205/457; 205/458

[58] Field of Search ..... 205/440, 457, 205/458

[56] References Cited

U.S. PATENT DOCUMENTS 5,443,698 8/1995 Mahoney et al. ..... 204/59 QM

*Primary Examiner*—Kathryn Gorgos
*Assistant Examiner*—Edna Wong
*Attorney, Agent, or Firm*—Duft, Graziano & Forest, P.C.; Dan Cleveland, Jr., Esq.

[57] ABSTRACT

A process for synthesizing metal 2-ethylhexanoates includes reaction of metals with a reaction mixture including a carboxylic acid, a low weight aliphatic alcohol, and an electroconductive additive under the action of electric current in an elecrolyzer. In the electrolyzer, an ion exchange membrane divides respective anode and cathode compartments. The metal is introduced in the form of an anode, and is preferably lead or bismuth. The carboxylate is preferably 2-ethylhexanoic acid. The electroconductive additive is preferably a salt of 2-ethylhexanoic acid and an alkali metal or ammonium cation.

10 Claims, 2 Drawing Sheets

SYNTHESIS OF METAL 2-ETHYLHEXANOATES

BACKGROUND OF THE INVENTION

1. Field of the Invention

The present invention pertains to the field of processes that yield metal carboxylates and, more particularly, metal 2-ethylhexanoates. Still more specifically, the process involves conducting an electrolytically assisted chemical reaction between a metal and a carboxylic acid in the presence of an aliphatic alcohol solvent which precipitates the metal carboxylate reaction product.

2. Description of the Prior Art

Metal 2-ethylhexanoates and other salts of aliphatic acids are used in the manufacture of products including plastics such as polyolefins, polyvinylchloride, acrylonitrile/butadiene/styrene copolymers, reinforced polyesters, polystyrene, and impact resistant polystyrene. Metal 2-ethylhexanoates are also used as stabilizers and lubricants in plastic molding. Additionally, metal 2-ethylhexanoates are used in paint, varnish, printing ink, lubricants, catalysts, and fuel additives. More recently, metal 2-ethylhexanoates have found other uses as metal-organic precursors in the preparation of high-quality films for microelectronics. These microelectronic precursors require extremely pure chemical compositions. It is often impossible to find or economically produce metal 2-ethylhexanoates having the requisite research-grade purity for microelectronics applications.

U.S. Pat. No. 2,899,232 describes a process for the preparation of metal 2-ethylhexanoates. In this process, oxides or hydroxides of Group 2 elements of the periodic table are subjected to direct fusion with melted fatty acids. The reaction is performed at high temperature, followed by cooling and milling. The products thus obtained are always contaminated with the unreacted oxides or hydroxides. It is very difficult to eliminate these impurities.

U.S. Pat. No. 2,584,041 describes another process for the preparation of oil-soluble metal 2-ethylhexanoates. Powdered metals are heated in the presence of 2-ethylhexanoic acid in the presence of water and oxygen. Mineral oil is typically used as a solvent. This reaction is characterized by a very long reaction time. After completion of the reaction, water is distilled off from the reaction mixture to leave a solution in mineral oil as the commercial product. These solutions also contain a substantial contaminant in the form of excess 2-ethylhexanoic acid, which may remain in the mineral oil up to 25% by weight. The use of ammonium salts as catalysts was suggested in European Patent Office publication 512,346 A2, however, the presence of ammonium salts precludes use of the solutions from use in most organic syntheses. European Patent Office publication 094,760 indicates that alkali metal cations can be used as catalysts, but the presence of alkali metals in solution makes the solutions unsuitable for use in microelectronic applications.

Metal carboxylates can also be produced by a double decomposition technique, as described by A. S. Shaikh and G. M. Vest, J. Amer. Ceram. Soc. V. 69, n9 682 (1986). The reaction mechanism involves a two step process which includes first preparing an ammonium soap of the carboxylic acid, then mixing the soap with a metal chloride or nitrate. The resultant metal salt is separated by extraction in the organic solvent, e.g., xylene. The double decomposition processing requires the use of expensive water-soluble metal salts and complex equipment. The desired reaction products are contaminated with reaction byproducts, and mostly 2-ethylhexanoic acid. Elimination of the excess acid requires vacuum distillation at high temperature, which results in thermal decomposition of 2-ethylhexanoates.

An electrolysis reaction is discussed by N. Kumar, D. G. Tuck, and K. D. Watson in 65 Can. J. Chem. 740 (1987). Ethylhexanoates of Mn, Fe, Ni, Co, and Cu are obtained by anodic dissolution of the respective metals in a simple cell. Platinum is used for the cathode, and the reaction with 2-ethylhexanoic acid is conducted in an acetone or acetonitrile solvent using $(CH_3CH_2O)_4NClO_4$ as an electroconductive additive. This electrolysis method cannot be utilized with some metals because such metals as bismuth and lead undergo electrolytic dissolution at the anode, but plate out at the cathode with no substantial net contribution to the metal content in solution. Additionally, the $(CH_3CH_2O)_4NClO_4$ electroconductive additive contaminates the final solution with chlorine, which can preclude use of the solution in microelectronic applications.

There remains a need for a process that is capable of yielding metal 2-ethylhexanoates in high yield and high purity for use in microelectronic applications.

SUMMARY OF THE INVENTION

The present invention overcomes the aforementioned problems by providing a method for synthesizing metal 2-ethylhexanoates in high yield and high purity. Process yields can exceed 65% or more, and the products have sufficient purity for immediate use as metal-organic precursors in the formation of semiconductor materials.

The method of the present invention is facilitated by the use of an electrolyzer having a metal anode received within an anode compartment, a cathode received within a cathode compartment, and an anion exchange membrane separating the anode compartment and the cathode compartment. An anolyte solution is prepared to include a mixture of an aliphatic carboxylic acid having a first molecular formula including five to ten carbon atoms, an aliphatic alcohol having a second molecular formula including up to five carbon atoms, and an electroconductive additive. In cases where a desired reaction product provides sufficient conductivity, a material corresponding to the end product may be used as the electroconductive additive to expedite precipitation of the reaction product. A catholyte solution is prepared in a similar manner; however, in this case the reaction product is not used as the electroconductive additive because the metal could plate out on the cathode. The anolyte solution is placed in the anode compartment to contact the anode and the membrane. Similarly, the catholyte solution is placed in the cathode compartment to contact the cathode and the membrane. Electricity is passed through the respective cathode and anode solutions between the anode and the cathode to facilitate a reaction between the metal anode and the carboxylic acid to form a metal carboxylate in the anode compartment.

The use of a low molecular weight aliphatic alcohol, i.e., one having five or fewer carbon atoms in its molecular formula, is preferred for the low solubility of metal carboxylates solvated by these alcohols. This low solubility facilitates removal of the solvated metal carboxylate as a precipitate from the anode compartment. Purification of the reaction product is correspondingly simplified as research grade purities can often be obtained in high yield by recrystallization or washing of the precipitate in the aliphatic alcohol solvent followed by desolvation of the precipitate. Desolvation preferably includes mild heating to temperatures less than about 100° C. or even less than about 80° C. while exposing solvated precipitate to a mild vacuum of from one to five mm Hg less than atmospheric pressure.

The most preferred aliphatic carboxylic acid is 2-ethylhexanoic acid, which leads to the formation of metal 2-ethylhexanoates. The preferred aliphatic alcohols include methanol, ethanol, and isopropyl alcohol, with methanol being most preferred for its low boiling point and the low solubilities of metal 2-ethylhexanoates in methanol. The carboxylic acid is preferably mixed with the aliphatic alcohol in an amount that preferably ranges from five to ten percent carboxylic acid by volume. This range of carboxylic acid facilitates dissolution of the anode by preventing the formation of reaction-inhibiting scale on the anode. Metals from Groups II–IV may be used in the reaction. The most preferred metals for use as the anode include lead and bismuth, which will not react with carboxylic acids without action of electrical current and, even in an electrolyzer, will not form appreciable quantities of metal 2-ethylhexanoates in an electric cell that is not equipped with an anion exchange membrane, as these metals are readily precipitated at the cathode. The electroconductive additive preferably includes an alkali metal salt or an ammonium cation moiety. The reaction is preferably conducted by providing a current intensity at the anode ranging from 0.5 to 2.5 amperes/$dm^2$.

Formula (1) describes the generalized reaction chemistry:

$$XR-COOH+M^x \rightarrow M(-OOC-R)_x+V\frac{X}{2}H_2 \quad (1)$$

In Formula (1), M is a metal having valence requirements of X; R is an alkyl group having from four to nine carbons in either a branched or unbranched form; C is carbon; O is oxygen; and H is hydrogen.

Other salient features, objects, and advantages will be apparent to those skilled in the art upon a reading of the discussion below in combination with the accompanying drawings.

DETAILED DESCRIPTION OF THE PREFERRED EMBODIMENT

Figure 1:
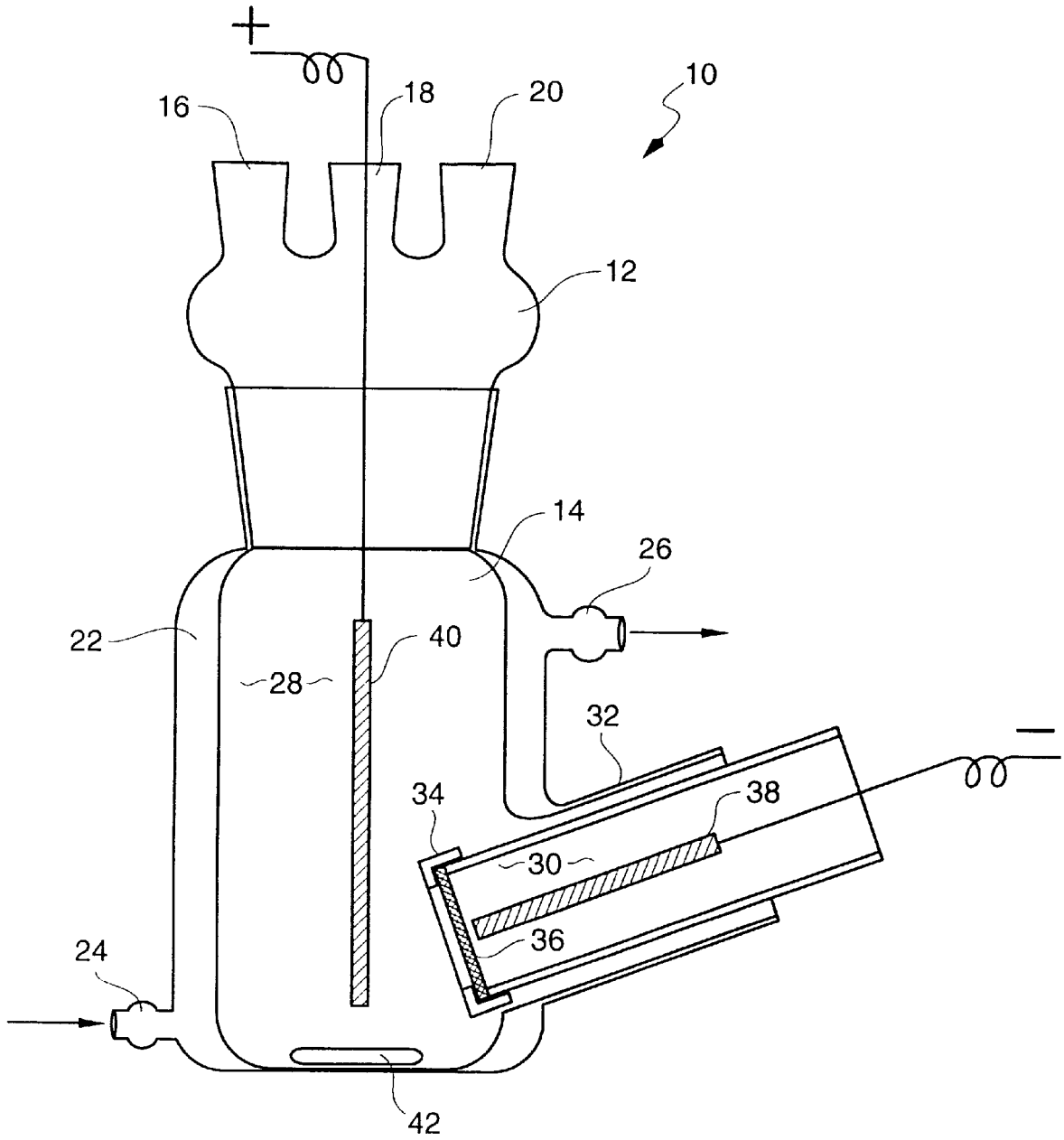
FIG. 1 depicts an electrolyzer for use in conducting electrochemical reactions in accord with a preferred embodiment of the present invention.

FIG. 1 depicts a glass cylindrical electrolyzer 10 including a threaded detachable lid 12, and a reaction vessel 14. Electrolyzer 10 is not required to perform the reaction of Formula (1); however, it presents a preferred apparatus for use according to one embodiment of the present invention.

Lid 12 contains several openings or offsets that are configured to permit the use of electrolyzer 10 in combination with other equipment, as required. These openings include a reflux condenser offset 16, an anode-receiving offset 18, and a thermometer-receiving offset 20.

Reaction vessel 14 includes an outer cylindrical water jacket 22 having a water inlet 24 and a water outlet 26, an anode compartment 28 that is generally concentric to water jacket 22, and a cathode compartment 30 that is received in a cylindrical cathode compartment offset 32 within the outer wall of reaction vessel 14. Cathode compartment 30 is a fluoroplastic cylinder having a union nut 34 that threadably attaches at the bottom of the cylinder to seal and retain an anion exchange membrane 36 separating anode compartment 28 from cathode compartment 30.

A list of suitable commercially-available anion exchange membranes 36 includes an Aciplex membrane manufactured by Asahi Chemical Industries, an AMFion A-310 membrane manufactured by AMF Inc., a Permaplex A-20 membrane manufactured by Permitt, Ltd., a Permaplex C-10 membrane (also manufactured by Permitt, Ltd.), or a Russian-made membrane MA-40 or MA-41 manufactured by Schyokinsky PO "Azot," Pervomaysky-1, Schyokinsky region, Tula, 301212, Russia. The Russian membrane is preferred, and is made by graft copolymerization of aromatic and aliphatic polyolefins, with further amination to provide the desired anion exchange properties. Any suitable anion exchange membrane may be used, so long as it has the ability to permit the transfer of carboxylate reagents between anode compartment 28 and cathode compartment 30, and the ability to prevent the transfer of metal cations from anode 40 into cathode chamber 30.

A cathode 38 is located and sealed in cathode compartment 30. An anode 40 is located and sealed in anode compartment 28. A magnetic stirrer 42 is present at the bottom of anode compartment 28.

In operation, anode compartment 28 and cathode compartment 30 are filled with the reaction mixture including an electrolyte as needed to enhance conductivity. In the course of electrolysis without anion exchange membrane 36, positively charged metal ions from anode 40 can sometimes plate out on cathode 38. Anion exchange membrane 36 interferes with this plating by permitting only the transfer of anions between cathode compartment 30 and anode compartment 28. Anion exchange membrane 36 also retains cations within anode compartment 28 for reaction therein. During electrolysis, cathode 38 and anode 40 are preferably maintained at a suitable voltage differential sufficient to place a current density ranging up to about five amperes/$dm^2$ across the anode to assist the chemical reaction. The most preferred current density is from 2.5 to 5 amperes/$dm^2$.

Figure 2:
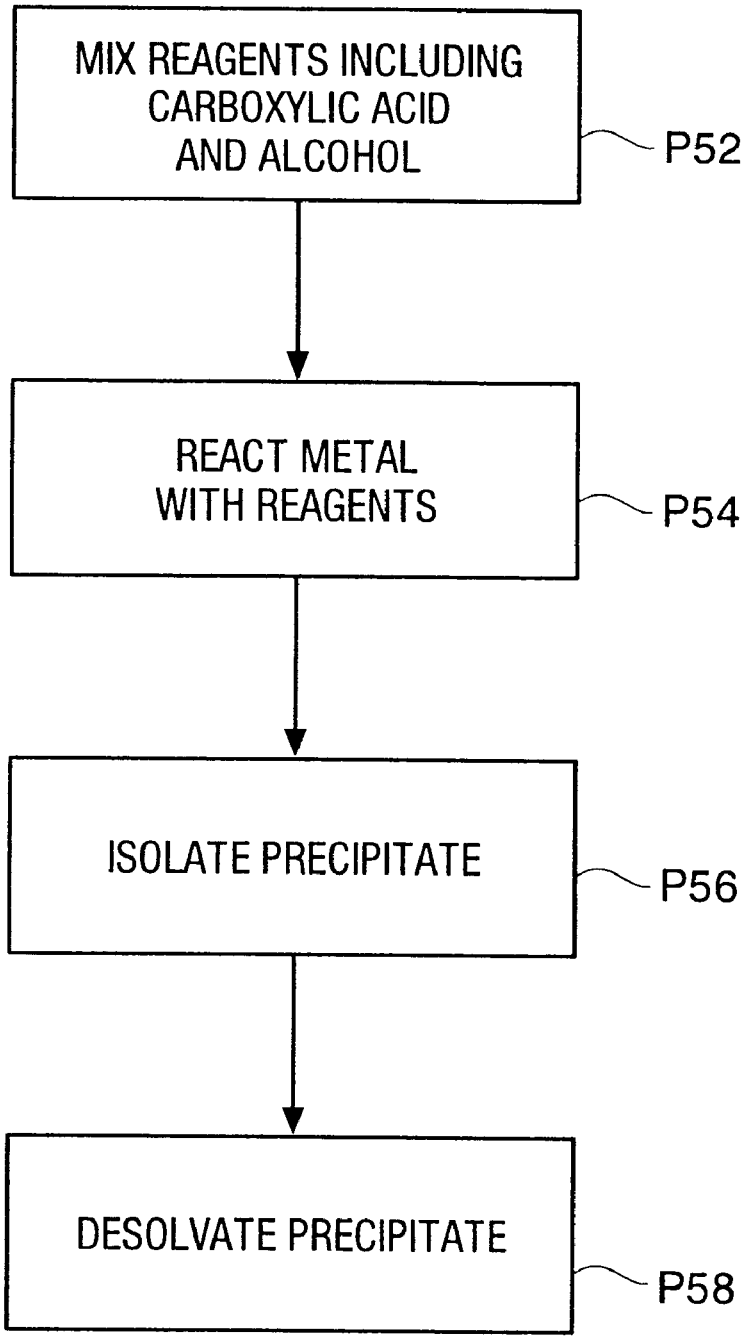
FIG. 2 is a schematic process diagram that depicts a process according to the present invention.

FIG. 2 depicts process P50 according to the present invention. Step P52 includes the mixing of liquid reagents, namely, a carboxylic acid having a first molecular formula with from six to ten carbon atoms and an aliphatic alcohol having a second molecular formula with up to five carbon atoms. The resultant mixture preferably has a ratio of carboxylic acid to alcohol ranging from five to ten percent by volume. The alcohol preferably has a water content of less than about 0.1% by volume. The reaction mixture also includes a suitable amount of an electrolytic agent to enhance conductivity without interfering with the reaction of Formula (1). In cases where the desired reaction product provides sufficient conductivity, it is preferred to add material corresponding to the desired reaction product as the electrolyte, in order to expedite precipitation. Alternatively, it is preferred to use as the electrolyte a carboxylate corresponding to the (—OOC—R) group of Formula (1) bonded to an alkali metal cation or an ammonium cation.

A 0.1 N concentration of ammonium 2-ethylhexanoate is recommended for use as the electrolytic agent during the synthesis of metal 2-ethylhexanoates. Additionally, it is preferred to introduce ammonium 2-ethylhexanoate in the catholyte as required to maintain a substantially constant concentration of ammonium 2-ethylhexanoate or 2-ethylhexanoic acid ions in the anolyte. The characteristics of the anion exchange membrane permit transfer or motion of these ions across the membrane as required to maintain solution equilibrium between the cathode and anode compartments. Thus, continuity of electrical current is assured despite the removal of carboxylate moiety from the anolyte solution due to reaction and subsequent precipitation of the metal carboxylate reaction product.

Step P54 includes reacting the metal with the reagents. The reaction proceeds according to Formula (1) under the action of electrical current.

Step P56 includes isolating the precipitate formed by the reaction. This precipitate contains a metal carboxylate in accordance with Formula (1). Isolation of the insoluble precipitate permits an extremely simplified purification procedure to provide a high purity product in high yield. The yield or reaction efficiency is often greater than 65%, and can be as high as 96% based upon weight reduction at the anode. A mere solvent wash or recrystallization is often sufficient to purify the product to a purity that exceeds the purity of commercially available research grade materials derived from alternative methods. The reaction temperature is preferably controlled in a range of 55–65° C., but may be performed at temperatures outside this range. This temperature range affords an optimal reaction rate without thermal damage to the reaction product.

Step P58 includes desolvating the precipitate obtained from step P56. The precipitate of step P56 is usually an extremely pure form of metal carboxylate in a solvated form. Desolvation is preferably accomplished by heating the precipitate of step P56 to a temperature of less than about 100° C. in a vacuum oven while exposing the solvated precipitate to a mild vacuum having an absolute pressure ranging from about one to five mm Hg less than atmospheric pressure. Desolvation is most preferably accomplished at temperatures less than 80° C. to avoid thermal damage to the metal carboxylate product. In fact, the entire process P50 is preferably conducted at a temperature of less than 80° C.

The following non-limiting examples describe preferred materials and techniques for use in practicing the present invention.

EXAMPLE 1

SYNTHESIS OF LEAD 2-ETHYLHEXANOATE

The electrolyzer depicted in FIG. 1 was used to assist the reaction. Preparation of the electrolyzer included installing a lead plate having an area of 3 $cm^2$ for use as the anode and a graphite rod having a surface area of 3 $cm^2$ for use as the cathode. The electrolyzer cathode compartment had a volume of 100 ml. The anode compartment had a volume of 30 ml. An anolyte mixture was prepared by combining 5 ml of 2-ethylhexanoic acid, 0.5 g of lead 2-ethylhexanoate, and 95 ml of methyl alcohol. The anolyte solution was then poured into the electrolyzer anode compartment. A catholyte reaction solution was prepared by mixing 5 ml of 2-ethylhexanoic acid, 0.5 g of potassium 2-ethylhexanoate, and 25 ml of methyl alcohol. The electrolyzer water jacket was maintained at a temperature ranging from about 50–55° C. throughout the entire synthesis. A current of 0.070 amperes was passed through the solution for six hours. A 5 ml volume of 2-ethylhexanoic acid was added to the catholyte at the end of the first 3 hours of electrolysis. The anolyte was cooled to room temperature (i.e., 20–22° C.) to form a precipitate. The precipitate was isolated by filtration, recrystallized from methanol, and dried in a vacuum oven at a temperature ranging from 50–60° C. in an absolute pressure of 1–5 mm Hg for 7–8 hours. The product was 2.9 grams of a viscous transparent liquid for a 75.1% yield based upon weight reduction at the anode. Table 1 presents the results of chemical analysis on the product, and compares these results to calculated theoretical values based upon weight percentages.

TABLE 1

| WEIGHT PERCENTAGES OF ELEMENTS | Pb | C | H |
|---|---|---|---|
| Empirical Results (weight percent) | 41.81 | 38.94 | 6.10 |
| Calculated Theoretical Value (weight percent) | 41.98 | 38.90 | 6.08 |

Table 1 indicates that the product was lead 2-ethylhexanoate.

EXAMPLE 2

SYNTHESIS OF LEAD 2-ETHYLHEXANOATE

The synthesis of Example 1 was repeated under identical conditions, except the initial catholyte contained 7.5 ml of 2-ethylhexanoic acid. In this case, the process yield or efficiency was 3.3 grams of lead 2-ethylhexanoate or 85.49% of the maximum possible yield based upon weight reduction at the anode.

EXAMPLE 3

SYNTHESIS OF LEAD 2-ETHYLHEXANOATE

The synthesis of Example 1 was repeated under identical conditions, except the initial catholyte solution contained 10 ml of 2-ethylhexanoic acid. In this case, the process yield was 3.1 grams of lead 2-ethylhexanoate for an efficiency of 80.31%.

EXAMPLE 4

SYNTHESIS OF BISMUTH 2-ETHYLHEXANOATE

The electrolyzer of FIG. 1 was used to assist the reaction. The anolyte contained a solution formed from 10 ml of 2-ethylhexanoic acid, 1.6 g of ammonium 2-ethylhexanoate, and 90 ml of methanol. The anode was a bismuth plate having a surface area of 10 $cm^2$. The catholyte solution contained 3 ml of 2-ethylhexanoic acid, 0.5 g of ammonium 2-ethylhexanoate, and 27 ml of methanol. A graphite cathode having a surface area of 10 $cm^2$ was utilized. Electrolysis was conducted using a current of 0.100 amps for 20 hours. A 2 ml quantity of 2-ethylhexanoic acid was added to the catholyte solution every 3 hours. The anolyte solution was removed from the electrolyzer and filtered. The mother liquor was cooled to a temperature ranging from about 0–2° C. to precipitate crystals. The crystals were isolated by filtration, washed with methyl alcohol, and dried in a vacuum heater at a temperature ranging from about 50–60° C. for a duration of 7–8 hours. The product included 14.3 g of a viscous transparent liquid, namely, $Bi(C_7H_{15}COO)3$. Table 2 presents the analytical data for the product.

TABLE 2

| WEIGHT PERCENTAGES OF ELEMENTS | | | |
|---|---|---|---|
| | Bi | C | H |
| Empirical Results (weight percent) | 32.63 | 45.20 | 7.20 |
| Calculated Theoretical Value (weight percent) | 32.69 | 45.10 | 7.19 |

EXAMPLE 5

SYNTHESIS OF BISMUTH 2-ETHYLHEXANOATE

The synthesis of Example 4 was repeated under identical conditions, except the catholyte included a 7.5 ml of 2-ethylhexanoic acid. The process yield was 14.8 g of bismuth 2-ethylhexanoate for an efficiency of 93.08% based upon weight reduction at the anode.

EXAMPLE6

SYNTHESIS OF BISMUTH 2-ETHYLHEXANOATE

The synthesis of Example 4 was repeated in an identical manner, except the catholyte contained 5 ml 2-ethylhexanoic acid. The process yield was 14.2 g of bismuth 2-ethylhexanoate for an efficiency of 89.31%.

Those skilled in the art will understand that the preferred embodiments, as described hereinabove, may be subjected to apparent modifications without departing from the true scope and spirit of the invention. Accordingly, the inventors hereby declare their intention to rely upon the Doctrine of Equivalents, in order to protect their full rights in the invention.

We claim:

1. A method for synthesizing metal carboxylates, said method comprising the steps of:

providing an electrolyzer that includes a metal anode received within an anode compartment, a cathode received within a cathode compartment, and an anion exchange membrane separating said anode compartment and said cathode compartment, said metal anode including a metal selected from a group consisting of lead and bismuth;

preparing an anolyte solution and a catholyte solution, each solution including a mixture of an aliphatic carboxylic acid having a first molecular formula including five to ten carbon atoms and an aliphatic alcohol having a second molecular formula including up to five carbon atoms;

placing said anolyte solution in said anode compartment and said catholyte solution in said cathode compartment; and conducting electricity between said anode and said cathode to ensure a reaction between said metal anode and said carboxylic acid to form a metal carboxylate in said anode compartment.

2. The method as set forth in claim 1 including a step of isolating a substantially pure metal carboxylate from said anolyte solution.

3. The method as set forth in claim 1 wherein said preparing step includes use of 2-ethylhexanoic acid as said aliphatic carboxylic acid.

4. The method as set forth in claim 1 wherein said preparing step includes use of methanol as said aliphatic alcohol.

5. The method as set forth in claim 1 wherein said preparing step includes a step of introducing an electroconductive additive to said catholyte and anolyte solutions.

6. The method as set forth in claim 4 wherein said electroconductive additive is selected from a group consisting of alkali metal cations, ammonium cations, and mixtures thereof.

7. The method as set forth in claim 1 wherein said conducting step includes a step of introducing additional carboxylic acid to said catholyte solution for compensation of carboxylic acid depletion in said catholyte solution derived from anolyte-compensatory transfer of a carboxylic acid moiety across said membrane as carboxylic acid in said anolyte solution reacts with said metal anode.

8. The method as set forth in claim 1 wherein said preparing step includes a step of mixing said aliphatic carboxylic acid and said aliphatic alcohol in an amount ranging from five percent to ten percent carboxylic acid by volume.

9. The method as set forth in claim 1 wherein said conducting step includes a step of providing anode current density ranging from 0.5 to 2.5 amperes/$dm^2$.

10. A method for synthesizing metal carboxylates, said method comprising the steps of:

providing an electrolyzer that includes a metal anode received within an anode compartment, a cathode received within a cathode compartment, and an anion exchange membrane separating said anode compartment and said cathode compartment;

preparing an anolyte solution and a catholyte solution, each solution including a mixture of an aliphatic carboxylic acid having a first molecular formula including five to ten carbon atoms and an aliphatic alcohol having a second molecular formula including up to five carbon atoms;

placing said anolyte solution in said anode compartment and said catholyte solution in said cathode compartment; and conducting electricity between said anode and said cathode to ensure a reaction between said metal anode and said carboxylic acid to form a metal carboxylate in said anode compartment, wherein said conducting step includes a step of introducing additional carboxylic acid to said catholyte solution for compensation of carboxylic acid depletion in said catholyte solution derived from anolyte-compensatory transfer of a carboxylic acid moiety across said membrane as carboxylic acid in said anolyte solution reacts with said metal anode.

* * * * *